US006478450B1

(12) United States Patent
Grajcar

(10) Patent No.: US 6,478,450 B1
(45) Date of Patent: Nov. 12, 2002

(54) LIGHTING SYSTEM

(76) Inventor: Zdenko Grajcar, 3030 Lynn Ave., Saint Louis Park, MN (US) 55416

( * ) Notice: Subject to any disclaimer, the term of this patent is extended or adjusted under 35 U.S.C. 154(b) by 0 days.

(21) Appl. No.: 09/845,580

(22) Filed: Apr. 30, 2001

(51) Int. Cl.[7] ..... F21P 3/00

(52) U.S. Cl. ..... 362/249; 362/252; 362/231; 362/812; 40/581

(58) Field of Search ..... 362/231, 236, 362/293, 812, 226, 249, 250, 252, 240; 40/551, 581, 552; 174/254; 361/749, 750, 751

(56) References Cited

U.S. PATENT DOCUMENTS 4,173,035 A * 10/1979 Hoyt ..... 361/749
5,697,175 A * 12/1997 Schwartz ..... 362/800
5,918,966 A * 7/1999 Arnold ..... 362/293
6,042,248 A * 3/2000 Hannah et al. ..... 362/812
6,167,648 B1 * 1/2002 Dimmick ..... 362/812

* cited by examiner

*Primary Examiner*—Sandra O'Shea
*Assistant Examiner*—John Anthony Ward
(74) *Attorney, Agent, or Firm*—Angenehm Law Firm; N. Paul Friederichs

(57) ABSTRACT

A light system, including a channel sign having a cover, walls and a bottom; a power source; a wire harness coupled to the power source; a flexible conductor strip coupled to the wire harness, the flexible conductor strip defining solder pad openings and the flexible conductor strip coupled to the channel sign, the flexible conductor strip being foldable; a socket mounted to the flexible conductor strip, the socket including pin receptacles in electrical contact through the solder pad openings; and a light having conductive pins, the conductive pins disposed in the pin receptacles and a method of installing lights including mounting a flexible conductor strip to a structure; supplying power to the flexible conductor strip; electrically connecting lights to the flexible conductor strip to power the lights; and exchanging burned out lights with operable lights without removing the flexible conductor strip.

20 Claims, 4 Drawing Sheets

LIGHTING SYSTEM

FIELD OF THE INVENTION

The present invention relates to lighting systems and more particularly lighting systems used in signs.

BACKGROUND OF THE INVENTION

The first luminous tubes did not employ neon or any of the other rare gases. From 1893 to 1910, the so-called Moore tubes were prominent in the larger cities, but these were filled with nitrogen and carbon dioxide, two common gases. These tubes had a very short life.

In 1910, George Claude introduced the first commercial neon sign, and from that time until the outbreak of the First World War he was busy bringing his discoveries to the point where they could be introduced on a large scale. By 1925, luminous tubes with neon began to rapidly replace the more common incandescent-lamp signs and public interest in the neon signs grew. The tubes may be made in near any shape and most commonly in the shape of letters or trademarks. Numerous small companies formed to supply the market with signs, since it was found that transportation of the tubes is costly and the most economical place of making the tubes was near the place of installation. Neon lighting is found in all countries of the world. In some locals, such as many South American cities, neon signs provide a second service, that of lighting the city streets.

In 2001, California, among other places, struggle with energy demands. Neon tends to require a transformer and high voltage. Neon signs are often cited as a cause of over consumption of electricity. Merchants are reluctant to turn the signs off as the signs are a source of new business. Governmental authorities are seeking new ways to reduce electricity consumption such that all with a need for the limited supply of energy can acquire the supply that they need.

Neon signs have long been known for becoming non-operable, which generally is a result of broken bulbs. Neon bulbs are formed in a glass stretching type of process, which can create weak spots in the tubing. Insertion of pressurized gas tests whether the tube is strong, but this test has room for improvement. The bulbs may break or leak when filled with neon, brought to the work site, installed or through jarring that may occur after being installed. Such tubes may burn out immediately or at anytime. Today, it is common to see neon signs with one letter or other portion burned out.

Replacing the bulb requires customized work that routinely takes several weeks to perform, during which additional bulbs may also burn out. This activity requires coordination of schedules of the custom manufacturer of the lights, trained installers, and merchant that needed the bulb replaced. The light manufacturer has the tools and skill to form the complex light tubes. Trained installers have the knowledge and ability to protect the new bulb from the point of manufacture through installation. The manufacturer and installer coordinate with the merchant to avoid disruption of customer flow through the merchant's place of operation.

Several, less than satisfactory new lighting systems have recently developed to overcome the energy, cost, breakage and replacement problems. PERMLIGHT™, 422 West Sixth Street, Tustin, Calif. 92780 developed the LED'R LIGHT™, which uses interconnected LED light modules. A typical 18" letter uses eighteen such modules; each interconnected with wire and connectors. When one connector fails, the entire letter goes out and substantial time and effort is needed to identify the interruption in the circuit. The modules are also of a size, shape and rigidity that make them difficult to install on curved surfaces and small strokes.

Hi*Tech Advanced Lighting Solutions, 13900 US Highway 19 North, Clearwater, Fla. 33764 has developed the IlumiLETTER channel letter lighting system. This system uses LED light modules that are mounted to wires via insulation displacement connectors, which are joined to a metal clip. The metal clip is joined to a surface with double sided tape. Problematically, the metal clip needs to be cut to various sizes for proper installation and a special tool is required for joining the modules to the wires. Insulation displacement connectors tend to corrode when used outside.

Supervision International, 8210 Presidents Drive, Orlando, Fla. 32809 developed EnVision LED Light bars. These rigid elongate bars come in a variety of lengths, which are joined to a surface with C-shaped mounting clips. The bars appear complex, at best, to use on curved areas such as the letter "S" of a sign. The bars are suspended in a channel that fills with water such that the water when frozen displaces the bar from the channel. DurLed Lighting Technologies Corporation, 15273 Alton Parkway, Suite 200, Irvine, Calif. 92618, SloanLED of Ventura Calif., and European Sign Systems, Lindauhohe 26, D-45259 Essen, Germany, all disclose light bars with function and problems similar to that described above.

SuperVision International, 8210 Presidents Drive, Orlando, Fla. 32809, has also developed FLEX-LED's™. This product has LED lights mounted on a strip with limited flexibility, e.g. bending radius of at least 1.5 inches, and a high volume of LEDs approximately 24–32 per foot.

What is needed is an energy efficient lighting system mountable to a variety of surfaces without the need for skilled technicians or special tools. The system should include LED or similar lights mounted on a bendable, foldable or creasable strip, but the system should remain durable such that frequent vibration does not injure the system. The lights should be removable for relamping. When a fault occurs, the system should indicate the location of the short and not require removal of the entire system for repair. Light should be cast with uniform light dispersion and the light color should be easily changed. The system should also be easy to install.

SUMMARY OF THE INVENTION

In one embodiment, the light system of the present invention includes a power source is coupled to a wire harness, which in turn is coupled to a flexible conductor. The flexible conductor strip defines solder pad openings. The flexible conductor strip may be coupled to a channel sign. The flexible conductor strip is sufficiently flexible to be foldable and creasable. A socket preferably is mounted to the flexible conductor strip. Such socket includes pin receptacles in electrical contact with the flexible conductor strip through the solder pad openings. A light with conductive pins may be disposed in the pin receptacles.

In use, a method of installing lights is provided with the steps of mounting a flexible conductor strip to a structure, supplying power to the flexible conductor strip, electrically connecting lights to the flexible conductor strip to power the lights and exchanging burned out lights with operable lights without removing the flexible conductor strip.

Advantageously, the present invention provides a flexible, relampable, durable, vibration resistant, shock resistant, non-corrosive, water resistant energy efficient sign lighting system.

As an added advantage the system allows customizing the length of the flexible conductor strip via cutting to length with a scissors.

Further, the lighting system provides an easy to install sign lighting system for backlighting of commercial and residential purposes, allowing use in situations where fire hazardous signs (e.g., neon) are not allowed, it situations where energy efficiency is required, in situations where space is too small for different lighting systems such as neon or flourescent, in situations where the sign is the subject of frequent vibrations, in situations where the sign manufacturer does not own expensive neon equipment and in situations where electricity, preferably 110 volt, is not available, since the low level of needed power can be provided with photovoltaic cells, e.g. solar panels.

Yet another advantage of this invention is the relampability and interchangeability between low voltage high brightness vacuum, light-emitting diode (LED) light sources or different suitable light sources.

Still another advantage includes providing a flexible conductor strip with a bending radius of 0.05 inch or less, allowing proper light orientation through tortuous turns found in many signs.

Another advantage is the provision of an adhesive layer on the flexible conductor strip, allowing for easy installation.

Still another advantage is the ease of maintainance due to relampability of the lighting system and automatic detection and identification of shorts, defects and burned out light sources.

Still another advantage of the present invention is the diffusion of typically directional or non-uniform lighting using a white or colored silicon rubber boot to provide uniform, wide angle diffused illumination.

Advantageously, the system provides for increasing or decreasing illumination via adding or removing light sources.

And yet another advantage is provision of a low voltage power source that consumes significantly less energy than prior systems.

Advantages also include interchangeability of different types of lights and different colored boots with a single flexible conductor strip.

Other advantages of the present invention will become obvious to the reader and it is intended that these advantages are within the scope of the present invention. To the accomplishment of the above advantages, this invention may be embodied in the form illustrated in the accompanying drawings. However, attention is called to the fact that the drawings are illustrative only and that changes may be made in form and substance without departing from the spirit and scope of the present invention.

DETAILED DESCRIPTION

Figure 1:
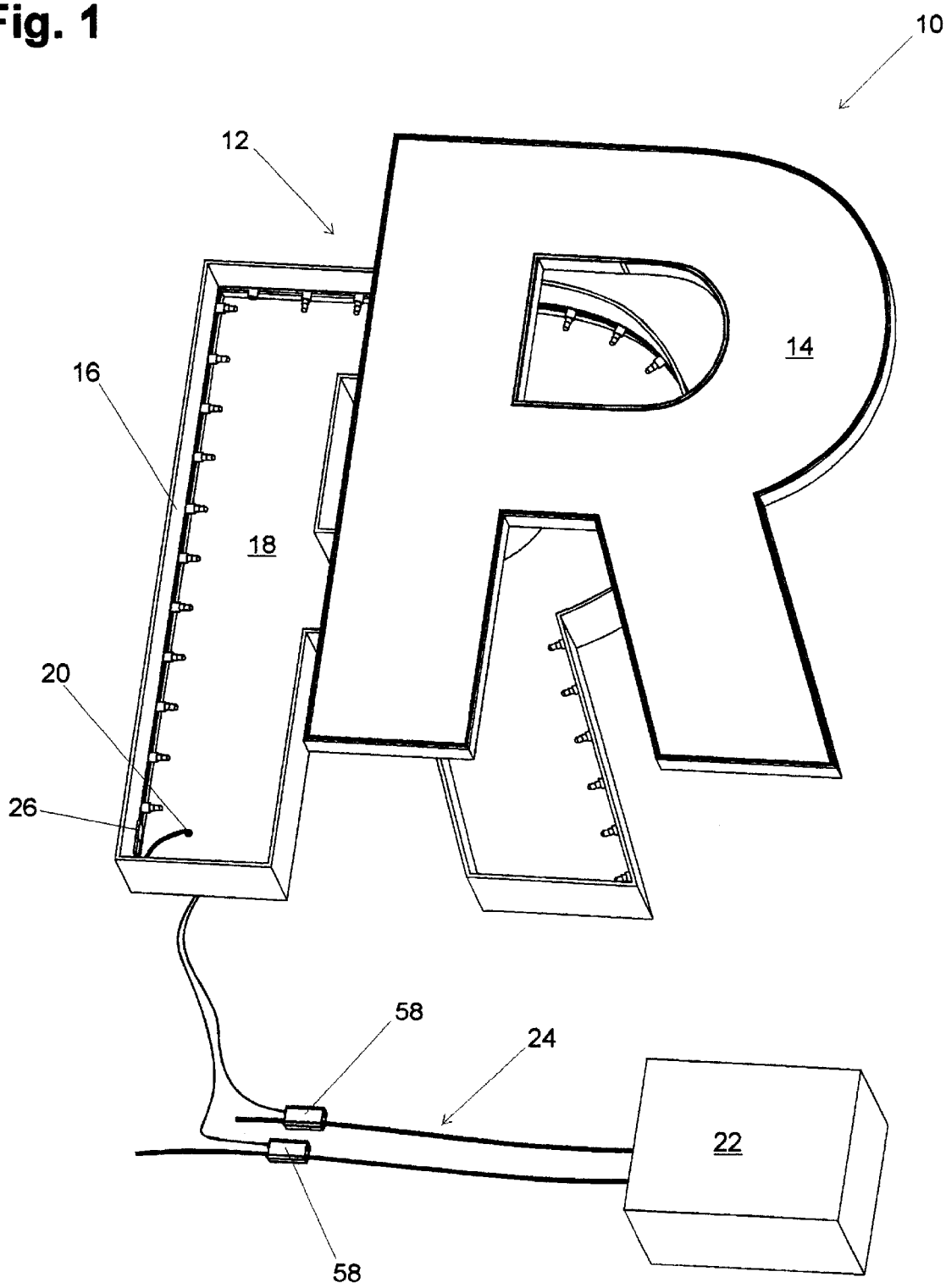
FIG. 1 is a prospective view showing the light system installed in a portion of a sign.

The light system 10 shown in FIGS. 1–8 preferably includes a channel sign 12 a power source 22, a wire harness 24 a flexible conductor strip 28, sockets 44 and a light 52.

The channel sign 12 may be a typical channel sign with a cover 14, walls 16 and a bottom 18. The energy efficiency of this system 10 advantageously offers a cooler lighting system allowing the channel sign 12 to be substantially smaller and to be used where fire hazard issues do not allow use of neon or other lighting systems, such as channel signs of less than 2" in width. The bottom 18 or walls 16 may define a sign access port 20 sized to receive the wire harness 24 therethrough. While this invention contemplates a channel sign 12 as a component, one skilled in the art can understand that the system 10 may be operated in the absence of such a structure or in a different structure.

Power source 22 should provide sufficient power to flexible conductor strip 28 and lights 52 mounted thereto. Power source 22 is a conventional encapsulated AC or DC power transformer.

Figure 2:
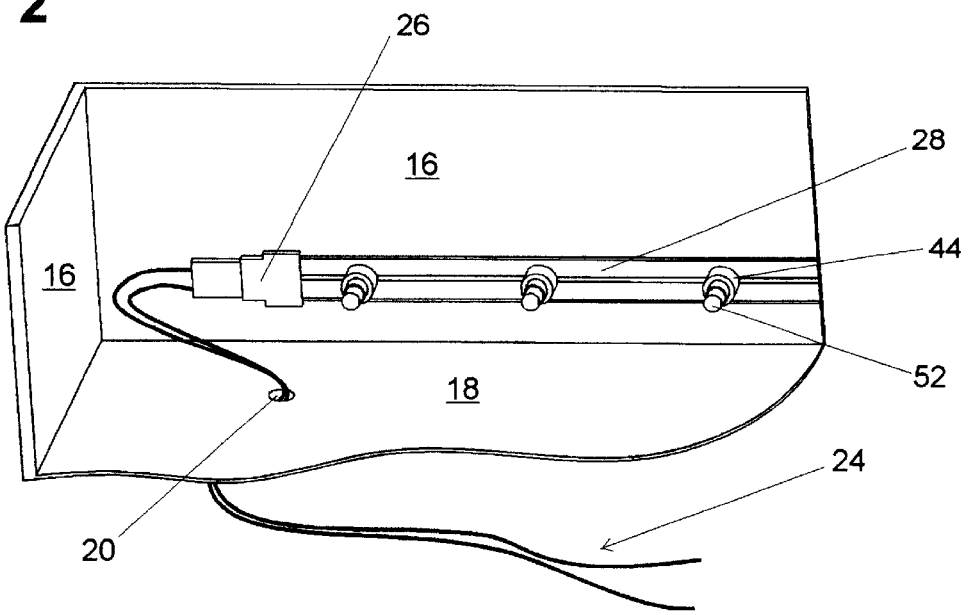
FIG. 2 is a break out view of a portion of the sign of FIG. 1 showing the electrical connector joined to the flexible conductor strip.
Figure 3:
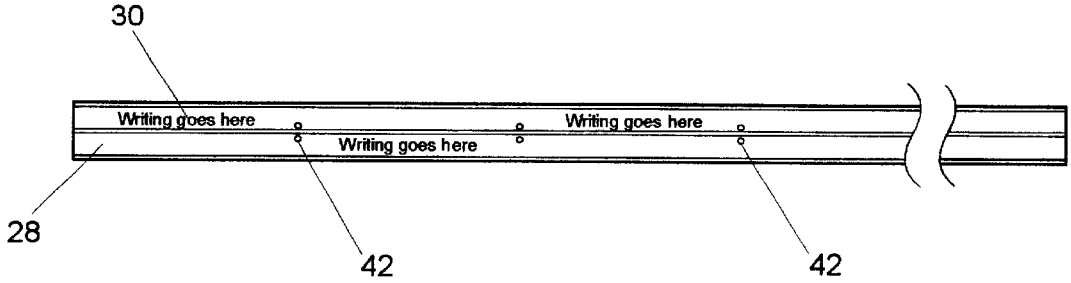
FIG. 3 is a prospective view of the flexible conductor strip without the sockets.

Wire harness 24 is coupled to the power source 22 and to flexible conductor strip 28. Multiple wires may be joined with an insulation displacement connector 58 as shown. The wire harness 24 is joined to the flexible conductor strip 28 with an electrical connector assembly 26 as shown in FIG. 2. Electrical connector assembly 26 preferably is a termination connector, which is a two-part piece, male and female, with one portion secured to the wire harness 24 and the other secured to the flexible conductor strip 28, such that the mating of the two-pieces electrically joins the wire harness 24 and the flexible conductor strip 28. Wire harness 24 is an optional component in that the flexible conductor strip 28 may be joined directly to the power source 22 through the electrical connector assembly 26.

Flexible conductor strip 28, shown in FIGS. 3–6 is formed of multiple layers. In particular, conductors 34, preferably of copper, are positioned between a base layer 36 and a top coverlay 32 and may be cut to length with a scissors. Top coverlay 32 may be a thin dielectric laminate such as polyimide, polyester or polyethylene with a single-sided adhesive on the bottom side and preferably has defined solder pad openings 42. Base layer 36 may be a thin dielectric laminate such as polyimide, polyester or polyethylene with a single-sided adhesive on the top side. Flexible conductor strip 28 is foldable, preferably with a bend radius of 0.05 inch or less, and is creasable. Silk screening 30 may be position above the top coverlay 32 and double-sided tape 38 with a pealable strip 40 may be positioned adjacent the base 36. Double-sided tape 38 may be used to join the flexible conductor strip 28 to the channel sign 12 or other structure as shown in FIG. 2. Flexible conductor strip 28 may be encased between the cover 14, walls 16 and bottom 18 of the channel sign 12 as indicated in FIG. 1.

Figure 4:
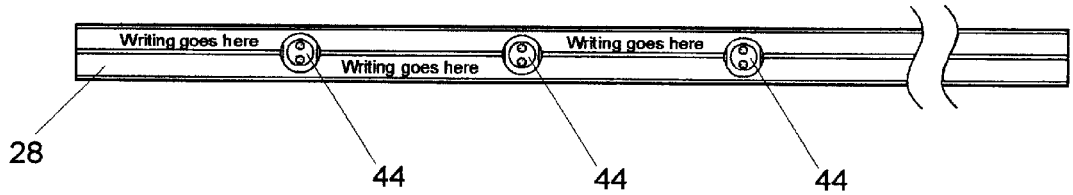
FIG. 4 is a prospective view of the flexible conductor strip with the sockets.
Figure 5:
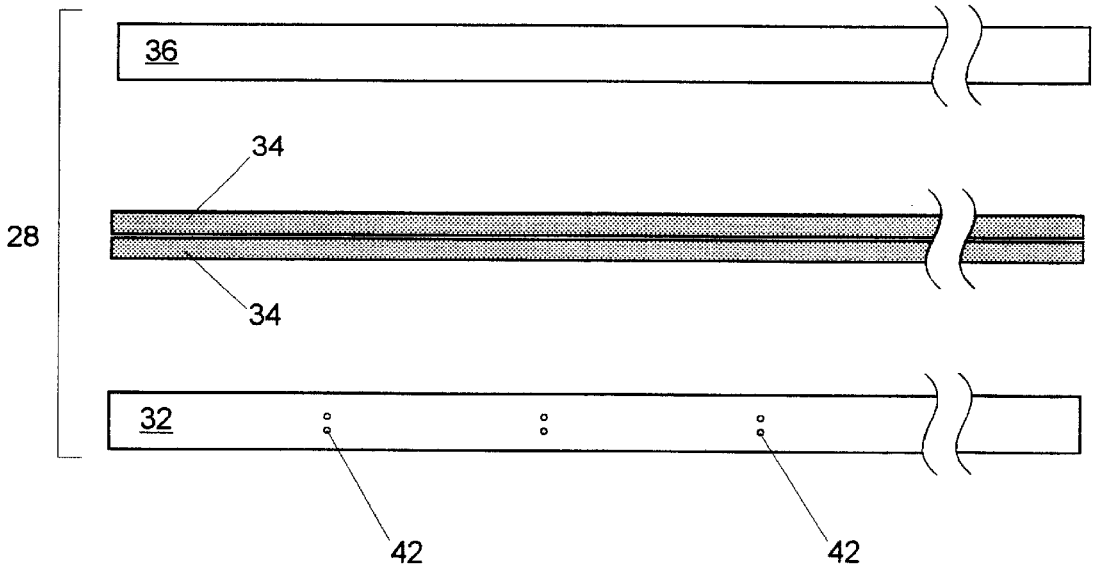
FIG. 5 is an exploded view showing the primary layers of the flexible conductor strip.
Figure 6:
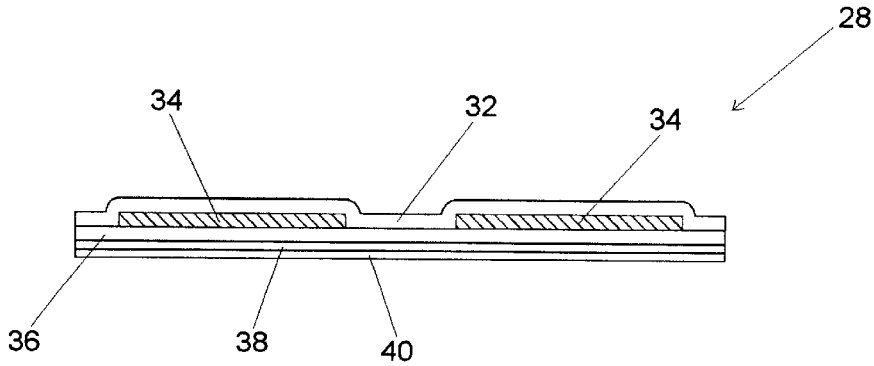
FIG. 6 is a partial cross-sectional view showing the preferred layers of the flexible conductor strip.
Figure 7:
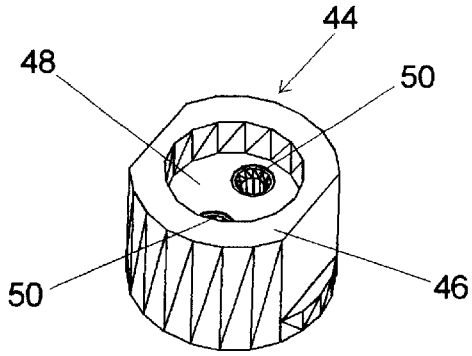
FIG. 7 is a prospective view of the socket.
Figure 8:
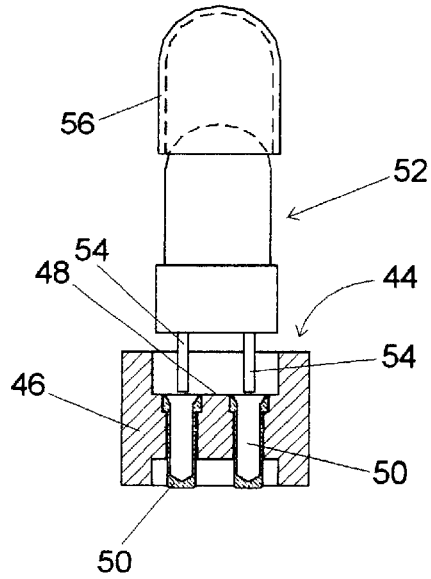
FIG. 8 is a partial cross-sectional view of the socket, showing a light bulb being inserted into the socket and a boot being positioned over the light bulb.

Socket 44, as shown in FIGS. 7 and 8, includes a circumferential wall 46 which meet near the axis to form a seat 48, which is sized and shaped for stabilization of lights 52. Pin receptacles 50, preferably two, may be defined through the seat and sized to snugly receive conductive pins 54 of the lights 52. Pin receptacles 50 may be welded or otherwise bonded to conductors 34 through solder pad openings 42, as shown in FIG. 4, thereby providing electrical communication between the flexible conductor strip 28 and the lights 52.

Lights 52 preferably are miniature, high brightness, low voltage vacuum lamps, LED (light-emitting diode) lamps or other suitable light source and include conductive pins 54, preferably two pins 54. Lights 52 are selectively securable within the sockets 44. One or more lights 52 may be attached to the flexible conductor strip 28.

Figure 9:
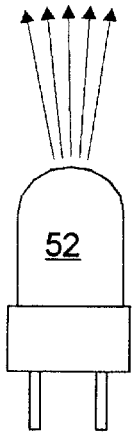
FIG. 9 is a prospective view of a light source showing the typical light dispersion.

Light boots 56, preferably formed of silicon, are available in a wide variety of colors and translucent white, may be easily interchanged, are optional and are disposable. A light boot 56, formed of thin polymer, are found to be useful to diffuse the directional lighting or narrow emission angle, e.g., hot spots, offered by LEDs to a radiating light, e.g., uniform light dispersion. This is demonstrated in a comparison of FIGS. 9 and 10, which shows the distribution of light rays.

In operation, lights 52 may be installed with the following steps. A flexible conductor strip 28 is mounted, which may be permanently mounted, to a structure such as a channel sign 12. Flexible conductor strip 28 may be folded to the point of creasing, advantageously allowing connection of conductor 28 to an object with acute, sharp angles such as angles found in the letter "N" in a channel sign 12. Power source 22 supplies power through a wire harness 24 to the flexible conductor strip 28. Lights 52 receive electrical power through the flexible conductor strip 28 and are thereby empowered.

Burned out lights 52 may be disconnected from the flexible conductor strip 28 and replaced with an operable light 52 without removal or replacement of the flexible conductor strip 28. In this manner, various types of suitable light sources may be exchange with any other suitable type of light source. Colored light sources 52 may be used and exchanged with lights 52 of different colors.

Figure 10:
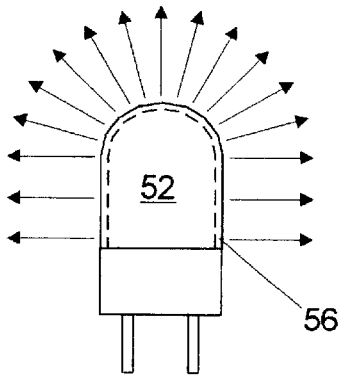
FIG. 10 is a prospective view of a light source in combination with a silicon boot, showing the improved light dispersion.

As shown in FIG. 10, boots 56 may be disposed over lights 52 to disperse directional lighting and alter coloration of the lighting. Where a white light source 52 is used, a boot 56 having one color may be removed and replaced with a boot 56 having a different color to change to color of the light. Thus, changing the color of light of a particular sign allows the flexible conductor strip 28 to remain in place throughout the entire process.

Although the present invention has been described with reference to preferred embodiments, workers skilled in the art will recognize changes may be made in form and detail without departing from the spirit and scope of the invention.

I claim:

1. A light system, comprising:

a channel sign having a cover, walls and a bottom;

a power source;

a wire harness coupled to the power source;

a flexible conductor strip coupled to the wire harness, the flexible conductor strip defining solder pad openings and the flexible conductor strip coupled to the channel sign, the flexible conductor strip having a bending radius of 0.05 inches or less;

a plurality of sockets mounted to the flexible conductor strip, the sockets including pin receptacles in electrical contact through the solder pad openings; and a plurality of lights having conductive pins, the conductive pins disposed in the pin receptacles.

2. The device of claim 1 wherein the flexible conductor strip is encased between the cover, walls and bottom of the channel sign.

3. The device of claim 1 wherein the flexible conductor strip is foldable and creasable.

4. The device of claim 1 wherein the lights are light-emitting diodes.

5. The device of claim 1 wherein the bottom of the channel sign defines a sign access port through which the wire harness may extend.

6. The device of claim 1 further comprising:

a boot disposed about the light.

7. The device of claim 1 wherein each light is selectively secured within each socket.

8. A light system, comprising:

a power source;

a wire harness coupled to the power source;

a flexible conductor strip coupled to the wire harness, the flexible conductor strip being foldable; and a light coupled to the flexible conductor strip wherein the light is of one type of light source and is adapted to be removed and replaced with a light source of a different type.

9. The device of claim 8 wherein the flexible conductor strip is coupled to a channel sign.

10. The device of claim 8 further comprising:

solder pad openings defined in the flexible conductor strip;

a socket mounted to the flexible conductor strip, the socket including pin receptacles in electrical contact through the solder pad openings; and a light having conductive pins, the conductive pins disposed in the pin receptacles.

11. The device of claim 8 further comprising a boot disposed over the light.

12. The device of claim 8 wherein the lights are selectively secured to the flexible conductor strip.

13. A method of installing and maintaining lights comprising:

mounting a flexible conductor strip to a structure, the flexible conductor strip being foldable and creasable;

supplying power to the flexible conductor strip;

electrically connecting lights to the flexible conductor strip to power the lights; and exchanging burned out lights with operable lights without removing the flexible conductor strip.

14. The method of claim 13 wherein the step of exchanging comprises the steps of:

changing the light from incandescent light sources to light-emitting diode light sources.

15. The method of claim 13 wherein the flexible conductor strip has a bending radius of 0.05 inches or less.

16. The method of claim 13 further including the step of adhering the flexible conductor strip to a channel sign.

17. The method of claim 13 further including the step of placing a boot over the light.

18. The method of claim 17 wherein the step of placing a boot further includes the steps of removing a boot having one color from a light and replacing with a boot having a different color.

19. The method of claim 17 wherein the boot is formed of silicon.

20. The method of claim 13 wherein the lights are low energy high brightness lights.

* * * * *